United States Patent [19]

Martin

[11] Patent Number: 4,846,067

[45] Date of Patent: Jul. 11, 1989

[54] WEATHERPROOF SAFETY FUSE IGNITER

[76] Inventor: Brian D. Martin, 15255 W. Maple Ave., Golden, Colo. 80401

[21] Appl. No.: 167,718

[22] Filed: Mar. 14, 1988

[51] Int. Cl.[4] ..... F42B 3/10; F42C 7/00; F42C 19/08

[52] U.S. Cl. ..... 102/275.6; 102/205; 102/275.11

[58] Field of Search ..... 102/275.1, 275.6, 275.5, 102/275.11, 275.12, 275.4, 205

[56] References Cited

U.S. PATENT DOCUMENTS

| | | | |
|---|---|---|---|
| 940,033 | 11/1909 | Larsen | 102/205 |
| 2,535,518 | 12/1950 | Rich | 102/275.6 |
| 3,296,968 | 1/1967 | Shulman et al. | 102/275.5 |
| 3,942,445 | 3/1976 | Baker et al. | 102/205 |
| 4,381,711 | 5/1983 | Lawrence | 102/275.11 |
| 4,493,240 | 1/1985 | Norton | 102/205 |
| 4,759,291 | 7/1988 | Barker et al. | 102/275.5 |

*Primary Examiner*—David H. Brown
*Attorney, Agent, or Firm*—James E. Pittenger

[57] ABSTRACT

A disposable weather-proof safety fuse igniter is provided which includes a hollow cylindrical housing having an internally spaced sleeve provided for mounting and positioning a pull-wire type friction igniter cup. The end of the pull-wire is attached to a vent plug positioned at one end of the housing which, in turn, is attached to a finger-grip device for extracting the vent plug and pull-wire for ignition. A threaded cap is provided to cover and seal the vent plug end of the housing. The opposite end of the housing includes a compression type sealing retainer which has an internal bore for insertion of the safety fuse. A double O-ring seal can be positioned within the housing with the retainer arranged so that rotation of the cap causes the O-ring seal to be compressed against the inserted fuse. Internally arranged ferrules are provided within the internal sleeve for properly positioning the end of the inserted fuse, retaining the fuse in proper position for use, and channeling the flame from the primer upon ignition to light the end of the safety fuse. A metering aperture in the sleeve and a passageway through the housing allows the exhaust gases to be accurately vented. A shipping plug is provided for insertion into the end of the sealing retainer to render the device weather-proof during shipping and storage.

20 Claims, 2 Drawing Sheets

WEATHERPROOF SAFETY FUSE IGNITER

FIELD OF THE INVENTION

This invention is directed to a manual type weather-proof igniter for igniting safety fuse. It is more specifically directed to a disposable improved weather-proof safety fuse igniter incorporating ignition control features.

BACKGROUND OF THE INVENTION

Safety fuses have been used for many years for the ignition and detonation of various types of explosives. At the present time, there are two types of safety fuse which are presently in use. The safety fuse which is used by the military and government is a composite of black powder which has an external layer or wrap of textile material. An outer sheath or layer of relatively smooth plastic is provided to maintain and provide a water-proof condition so that the fuse can be used in all types of environment.

The type of safety fuse which is primarily used for commercial use is slightly different from the military type in that a layer or coating of asphalt is applied to the outside surface of the textile wrap provided on the fuse. This asphalt layer is used as a sealant between the fuse and the blasting cap or ignition device. In this way, the entire assembly is sealed to prevent water from entering the connection with the ignitor or blasting cap which, in turn, would render the fuse, ignitor or blasting cap unreliable or inoperative.

The military type safety fuse, because it has a relatively smooth outer plastic layer, does not inherently provide this sealing effect. As a result, it is necessary to provide a separate sealing arrangement to prevent the introduction of water in the connection between either the igniter or the blasting cap.

The prior art device which is used by the military and other government agencies to ignite military type safety fuse is the M-60 igniter which was intended to be a reusable igniter. After being used to ignite a fuse, the igniter is removed from the burnt fuse, disassembled and a new primer charge is inserted, thus, the unit is reloaded and is again ready to be used.

It is a common known fact, however, that most M-60 igniters are not reused. The operation requiring the ignition or lighting of a fuse leading to an explosive charge is a nervous and dangerous time for all participants. As a result, it is very unlikely (not to mention unsafe) that a serviceman or other user will take the necessary time to remove the M-60 igniter from the fuse either before or after the charge has exploded. Hence, in most cases the M-60 igniter is discarded and not reused. This is especially true because the serviceman, in most cases, has an endless supply of igniters which minimizes the necessity to reload the igniter. In addition, the cost to retrieve, reload the M-60 and stock spare primers must come close to or exceed the cost of the M-60.

As a result of the fact that the M-60 igniter is relatively expensive, it has been shown that there is a definite need for a disposable type fuse igniter which is not only inexpensive to produce so that it can be discarded, but also must be extremely reliable and meet all military, government and commercial specifications. As a result, the present invention is directed to an inexpensive, water-proof fuse igniter which is a one-use throw-a-way disposable igniter.

INFORMATION DISCLOSURE STATEMENT

The following information is provided in compliance with the inventor's duty to disclose all pertinent information which is relevant to the information which is the subject of this application.

Although there are a number of issued patents directed to primer igniter devices, the patents which are listed here are believed to be the most pertinent which are known to the applicant.

The Baker, et al. patent (U.S. Pat. No. 3,942,445) is directed to a friction igniter assembly having a pull-wire coated with a friction-sensitive composition which is intended to be drawn through a chemical igniter composition. One end of the pull-wire which is coated with the friction composition is deformed in a zig-zag arrangement to increase the friction when the wire is drawn through the igniter material. The opposite end of the pull-wire is securely attached so that it can be withdrawn with respect to the ignition composition to produce the desired ignition flame.

The Beach patent (U.S. Pat. No. 82,586) discloses an enclosed, sealed torpedo for use in oil well servicing. This patent describes a sealed container which includes an explosive charge and a plurality of friction-primers. A pull-wire is arranged to be connected with the primers which are embedded in the explosive. By withdrawing the pull-wire, the primers are simultaneously ignited which, in turn, ignites the explosive charge.

The Michaelis (U.S. Pat. No. 333,655), Sharp, et al. (U.S. Pat. No. 549,297) Ballreich et al. (U.S. Pat. No. 3,416,450) patents all show friction-type igniters. All of these devices show pull-wire arrangements for igniting a friction charge which, in turn, ignites an explosive charge. It is interesting to note that although all of these devices show friction igniters, they are not used in conjunction with safety fuse products.

German patent 299,044 discloses a pull-wire type igniter which is intended for igniting a precharge which provides a directed ignition flame. This device appears to be an enclosed or sealed unit which has an internal cylinder for housing the primer as well as the precharge. It also appears that an opening is provided in the wall of the cylinder immediately upstream of the precharge.

European Pat. No. 0045226 is directed to a weather-proof or sealed igniter. An internal O-ring is provided for sealing one end of the primer sleeve.

SUMMARY OF THE INVENTION

This invention is a friction-type water-proof igniter for use with safety fuse. Although it is primarily intended for use with military type safety fuse, it can also be used with the commercial type or any other product wherein it is desired to ignite the end of a fuse or an explosive charge by the use of a primer.

The igniter incorporates a molded or conveniently shaped housing which encloses a pull-wire and igniter or primer cap. At one end of the housing is a vent plug which is attached to the end of the pull-wire and includes a seal to prevent the introduction of moisture or contaminants. A Nylon cord or other finger-gripping device is attached to the vent plug for easy extraction. A closure cap is provided to cover the vent plug and further seal the end of the housing.

The housing is a hollow tube which has an internal retaining sleeve which supports and positions the end of the pull-wire and the igniter cap. The internal bore of the sleeve containing the igniter cap also contains two positioning ferrules which have a partially crimped and jagged edge at one end. The ferrules are positioned internally within the sleeve with the ends containing the jagged edges arranged toward each other. A predetermined space is provided between the ferrules with the end of the first ferrule arranged adjacent to the outer surface of the igniter cap. The partially crimped end of the first ferrule is precisely located a predetermined distance from the face of the igniter cap to position the end of the safety fuse at a proper distance from the cap. The second, oppositely arranged ferrule is provided to allow the safety fuse to be inserted through this ferrule and up to the end of the first ferrule. The crimped and jagged edge of the second ferrule presses against the outer layer of the safety fuse and prevents or restricts the removal of the safety fuse once it has been inserted.

One or more adequately sized vent openings are provided in the sides of the internal sleeve in the area between the two ferrules. The positioning and sizing of the metering vent hole is quite critical to the proper and reliable operation of the device. The vent hole must be positioned downstream of the end of the safety fuse and properly sized to maintain the desired back pressure within the housing adjacent to the fuse during the ignition. The hot gases and sparks from the igniter cup must be directed over the end of the fuse. It is known that too high a pressure in the ignition area can retard the ignition and burning of the fuse while a rapid exhaustion of the products of combustion can create a partial vacuum which will extract powder from the fuse which can cause failure of the fuse to ignite or cause unreliable burning of the fuse.

Sufficient internal clearance is provided around the sleeve within the housing to direct the exhaust gases internally within the housing and through internal slots provided to guide the exhaust gases outward through the end of the housing previously containing the vent plug.

The opposite end of the housing through which the fuse is inserted contains a double O-ring seal positioned in the bore provided for the fuse. A retaining cap or retainer is provided at this end of the housing which also includes a central bore for the passage of the fuse and a central core which contacts the double O-ring seal and causes the compression of the O-rings to seal against the inserted safety fuse. Slightly tapered surfaces around the outside edge of the retaining cap which contact ears located on the sleeve provide the compression forces on the O-rings when the retainer is rotated. For shipping and storage purposes, a solid insertable shipping plug is provided for insertion in the fuse end of the device for sealing the housing. At the time of use the retainer is rotated allowing the shipping plug to be removed and discarded and the safety fuse inserted. Once the fuse has been inserted, the retainer is rotated in the opposite direction to reseal the opening and to prevent the intrusion of water or contaminants.

The invention is quite novel from the standpoint that the components used in fabricating the device can be manufactured from inexpensive materials. Any material can be used which is easy to machine or mold and which is not corrosive or reactive with the anticipated environment. In most cases, it is anticipated that various types of suitable plastics which can be easily fabricated will be used. The ferrules, because of the high temperatures involved and the strength requirement to retain and hold the safety fuse in proper position, should be fabricated from a relatively strong material such as steel, copper or aluminum. The finger pull-grip which is attached to the vent plug can be fabricated from any suitable material such as flexible wire or Nylon cord. It is understood that the pull wire and igniter cup are conventional items and are fabricated from suitable materials which are adequate for their intended purposes.

BRIEF DESCRIPTION OF THE DRAWINGS

Other features and advantages < of the present invention become apparent from the following detailed description wherein like reference numbers denote the same elements in the accompanying drawings.

DETAILED DESCRIPTION OF THE DRAWINGS

Figure 1:
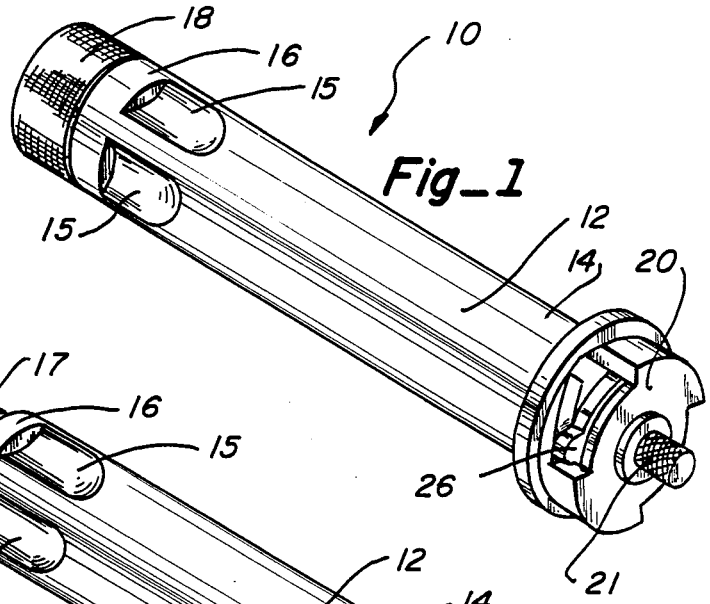
FIG. 1 is a perspective view of the safety fuse igniter as provided in the present invention.
Figure 2:
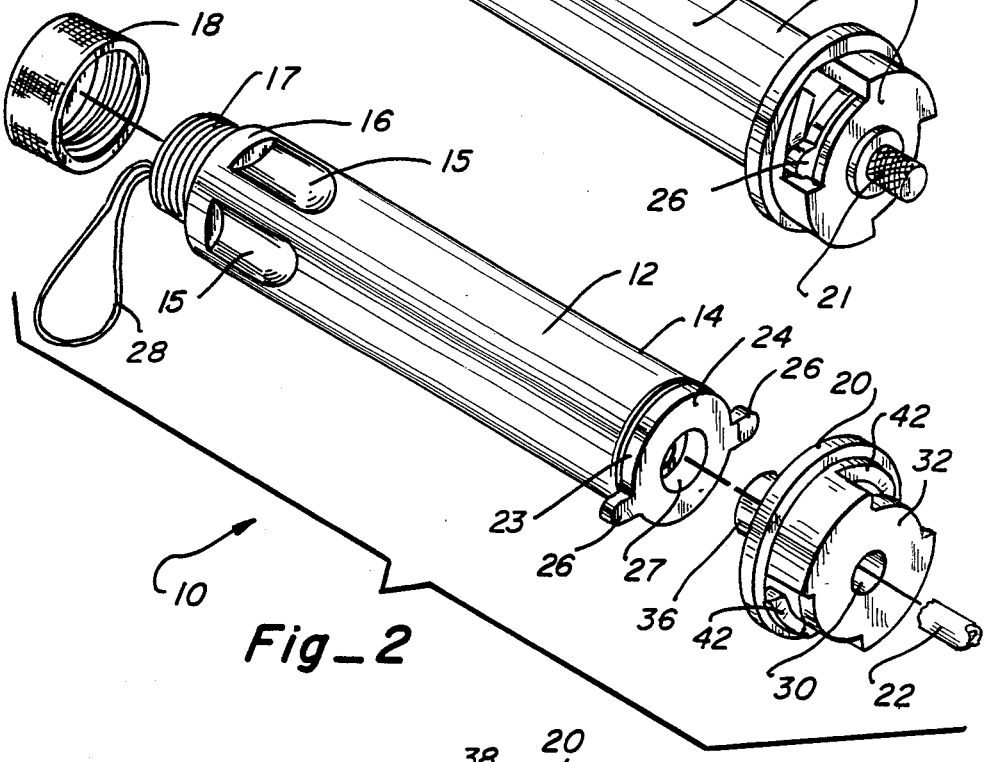
FIG. 2 is a partially disassembled perspective view of the igniter showing the major removable components.

Turning now more specifically to the drawings, FIGS. 1 and 2 show a perspective view of the weatherproof igniter 10 according to the present invention as well as a partially disassembled view of the same igniter. The igniter 10 includes a hollow housing or body 12 having one end 14 and the opposite end 16. Near the end 16 of the housing 12 are located a number of shallow depressions 15 which are arranged substantially around the circumference of the housing 12. The outer surface of the housing 12 can have various surface treatments such as circumferential grooves or knurling which will roughen the surface and provide a suitable gripping surface for the user. It is also understood that the depressions 15 could also be placed near the end 14 or could be eliminated entirely.

The housing end 16 includes threads 17 which are sized to accommodate a cover or cap 18. When the cap is threaded in position upon the end 16 of the housing 12, a sufficient space 19 is provided internally to retain and store the pull-cord 28 which is attached to the internal friction ignition primer and could also be attached to cap 18.

The opposite end 14 of the housing 12 includes an internal support sleeve 23 which has an end flange 24. This end flange contains outwardly extending lugs or ears 26 which are usually arranged diametrically opposite each other. A centrally positioned bore or channel 27 is provided in the end of the sleeve 23 to accommodate the insertion of the safety fuse 22. The outer end of the sleeve 23 is sized to slidably fit the inner diameter of the housing 12 and hold the sleeve in a rigid position. The sleeve 23 is suitably fastened within the housing by an adhesive or other attachment which will hold the sleeve and seal the joints to prevent the passage of moisture or other contaminants.

A seal retainer or retaining cap 20 is arranged for mounting on the end 14 of the housing 12. The retainer 20 is held in position by engaging the ears 26 on the flange 24 with the rotation of the retainer 20 causing pressure to be applied to an internal sealing device. When the safety fuse 22 is properly inserted through the opening 30 provided in retainer 20 and the channel 27 provided in the sleeve 23, the engagement of the retainer 20 and the rotation of the retainer with respect to the ears 26 causes the retainer to be latched with the result that an internal sealing device 25 pushes against the safety fuse 22 sealing the opening in the igniter 10 to prevent the intrusion of water, gases or contaminants.

During shipping and storage of the igniter 10, a removable plug 21 having an extended shaft with approximately the same diameter as the safety fuse is inserted through the opening 30 and channel 27 to engage the sealing device 25 and seal the end 14 when the retainer 20 is engaged. In this way, with the vent plug 100 and the retainer 20 properly positioned, the igniter housing 12 is completely sealed making it water-proof and contamination-proof so that the igniter 10 will have an extended shelf life and will be functionally reliable when needed for use.

Figure 3:
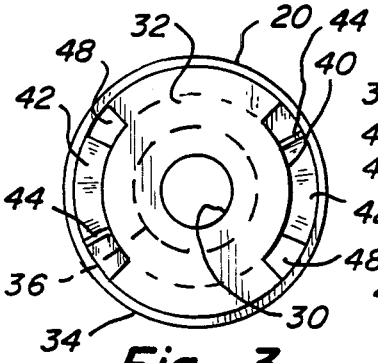
FIG. 3 is a top view of the fuse retaining cap.
Figure 4:
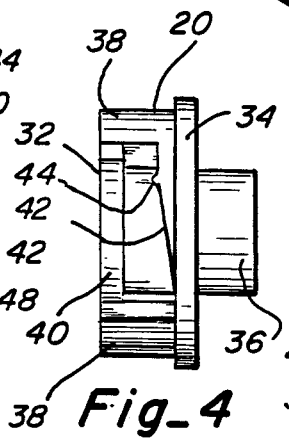
FIG. 4 is a side elevation view of the retaining cap.
Figure 5:
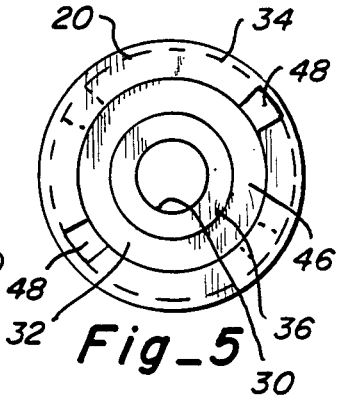
FIG. 5 is a rear view of the retaining cap.
Figure 6:
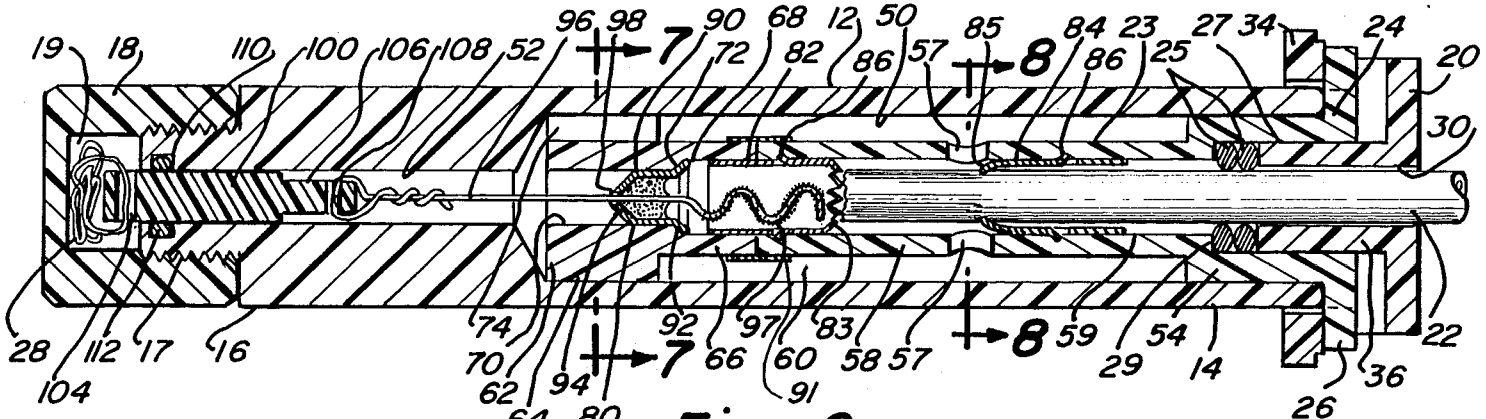
FIG. 6 is a cross-sectional view taken along the longitudinal axis of the igniter showing the inserted safety fuse.
Figure 8:
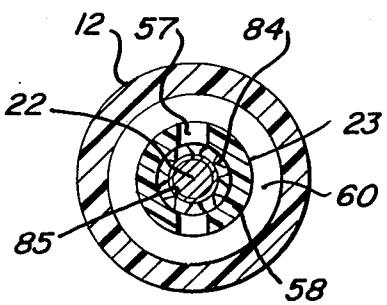
FIG. 8 is a cross-sectional view taken along lines 8—8 of FIG. 6.
Figure 7:
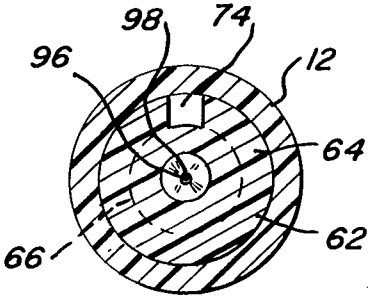
FIG. 7 is a cross-sectional view taken along lines 7—7 of FIG. 6.

The retainer 20 as viewed in FIGS. 3–5, includes an outer or front plate 32, hollow rearwardly extending circular core 36 including the longitudinal central opening 30. Side members 38 extend rearwardly from the front plate 32 and connected to an enlarged flat circular ring 34. The end of the circular core 36 extends beyond the ring 34 a sufficient distance to engage the internal sealing device 25 within the support sleeve 23.

The side members 38 of the retainer 20 are cut away leaving openings 40. These openings are diametrially opposite on each side of the retainer 20 and each extend approximately 90° around the circumference of the retainer 20. The segments of the cut-a-way openings 40 near the ring 34 form a circular inclined surface 42 which rises outwardly from the ring 34. Detents or raised areas 44 can be provided near the ends of the inclined surfaces 42 to form a retaining stop to hold the retainer 20 and prevent it from rotating or backing off accidentally with respect to the ears 26 as will be explained later.

The interior circular core 36 is spaced inwardly from outer members 38 which leaves an open area 46 therebetween. The outer diameter of the core 36 is slightly smaller than the inner diameter of bore 27 provided within the retainer sleeve 23. The space 46 is, in turn, sized to receive the outer flange 24 with slots 48 which are diametrically opposite, arranged to receive the ears 26. The slots 48 are provided in the ring 34 at the base of the inclined surfaces 42. In this way, the retainer 20 can be inserted over the outer flange 24 with the ears 26 passing through the suitably sized slots 48. Once the retainer 20 is inserted so as to engage the ears 26 on the inclined surfaces 42 a circular rotation in a clockwise direction as viewed in FIG. 2 will cause the ears to move along the inclined surface 42 and pass over and across the detents 44. This movement moves the end of the core 36 inward against the sealing device 25 provided in the bore 27 of the sleeve 23, which in turn, will apply pressure against the device causing the sealing function.

The sealing device 25 that is intended for use with the present invention is a double O-ring seal which is positioned within the channel 27. A shoulder 29 is formed within the channel 27 at a predetermined distance from the outer surface of the flange 24. The two O-rings can be identical and are sized to fit the diameter of the channel 27 and the diameter of standard safety fuse 22. With the fuse 22 or shipping plug 21 inserted, the inward pressure placed on the outer O-ring causes both O-rings seals to compress preventing the passage of water or other contaminants. It has been found that the double O-ring arrangement described herein provides unique results when used with safety fuse which is highly desirable in a device of this type.

To release the internal seal 25 it is merely necessary to rotate the retainer 20 in the opposite or counterclockwise direction. This causes the ears 26 to pass over the detent 44 which allows it to slide down the inclined surface 42 which moves the core 36 outward thus, relieving the force on the seal 25.

It is to be understood that because there is no real necessity in making the retainer removable from the housing 12, it is conceivable that the slots 48 can be filled or closed once the retainer has been positioned over the flange 24 and ears 26. Thus, the retainer can be moved from the locked or sealed position to the unlocked position and back without the retainer being separated from the housing 12. In this way, the retainer will not be lost or misplaced which could expose the interior of the housing 12 and render the igniter 10 ineffective.

The housing 12 is formed as a generally open, hollow elongated cylinder. Internally within the housing 12 is a large opening or bore 50 which extends approximately two-thirds of the length of the housing and which, in turn, narrows to a smaller diameter bore 52 towards the end 16.

The internal support sleeve 23 includes an enlarged section 54 which ends with the flange 24 exposed on the outside of the end 14 of the housing. This enlarged portion seals against the interior surface at the end of the housing 12 and also contains the internal bore 27 which is sized to receive the central core 36 of the retainer 20 and the sealing device 25. The sleeve 23 then transitions into an elongated narrow extension portion 58 which has a smaller diameter than the inside diameter of the housing bore 50. In this way, an exhaust vent chamber or cavity 60 is provided between the support sleeve 23 and the housing 12. A collet 62 having an enlarged end 64 and reduced end 66 is also provided. The outside diameter of the enlarged section 64 of the collet 62 is sized to slidably fit within the housing bore 50 to a point where it abuts the transition between the bore 50 and 52. The outside diameter of the extended end 66 of the collet 62 is the same as the support sleeve 23. An internal bore 68 which has the same diameter as the sleeve extension portion 58 is provided within the extending end 66. The bore 68 narrows in a tapered transition 72 to the bore 70 which passes through the enlarged end 64. At least one elongated vent slot 74 is provided along the outer surface of the enlarged end 64 of the collet 62. The purpose of this slot will be explained later.

The functioning components of the weather-proof igniter 10 include a friction primer igniter 80 and a pair of ferrules 82, 84. The ferrules can be fabricated from thin sheet metal and are of a hollow tubular configuration. It has been found through experimentation that a ferrule length of approximately $\frac{1}{2}''$–$\frac{5}{8}''$ is desirable. One end of each of the ferrules is cut in a serrated configuration having a number of sharp points or ends. The serrated ends are then crimped or bent inwardly slightly to partially close the end of the ferrule. The outer diameter of the ferrule is sized to allow the ferrule to slide inwardly through the inner bore of the extension 58 of the retaining sleeve 23, and also allow safety fuse to be inserted through the barrel of the ferrule.

If desired, one or more protrusions 86 can be punched in the side of the ferrule so that the metal is deformed outwardly from the side in a direction which is away from the crimped end of the ferrule. The protrusions 86 permit the ferrule to be inserted into the support sleeve to the desired position and anchors the ferrule in place. Any force applied to the crimped ends 83 of the ferrules 82, 84, respectively will cause the protrusions 86 to seat into the material of the sleeve or collet, further preventing the ferrules from being moved or dislodged.

The first ferrule 82 is slidably inserted, crimped end first, into the bore 59 through the outer end of the extended portion 58 of the support sleeve 23 to a point where slightly less than half of the ferrule 82 extends beyond the end of the sleeve. The second ferrule 84 is then inserted, crimped end first, into and through the channel 27 and into the reduced bore 59 to a point where the crimped ends of the ferrules are spaced apart a predetermined distance. In most cases, this will be approximately one-half inch. One or more properly sized metering vent apertures 57 are formed through the sides of the extension 58 of the support sleeve 23. These holes are positioned at a predetermined distance from the crimped end of the first ferrule 82 and at a point ahead of the second ferrule 84. The size and positioning of the vent apertures 57 are critical with respect to the end of the ferrule 82 as will be explained below.

The friction primer 80 includes a small metallic cup 90 which has a slightly flared end 92 with the opposite end 94 substantially closed. A pull-wire 96 is positioned through a hole 98 provided in the closed end of the cup 90. The end of the pull-wire 96 which extends beyond the cup 90 and into the interior of the ferrule 82 is formed in a series of curves or undulations 97. The opposite end of the pull-wire 96 extends outwardly through the bore 52. A cylindrically shaped vent plug 100 is positioned in the end of the bore 52 with one end sticking out into the space 19 provided within the cap 1 when it is installed. The end of the vent plug 100 which extends into the space 19, has a hole 104 through which a finger grip device 28 such as a pull-cord is attached. The opposite end of the vent plug 100 has a reduced diameter section 106 and a transverse hole 108. The end of the pull-wire 96 is inserted through the hole 108 and is twisted back on itself to secure the wire to the plug.

In order to seal the bore 52 to prevent the introduction of moisture or other contaminants a circular groove or shoulder 110 containing an O-ring 112 is provided within the bore 52. The O-ring 112 is sized to properly fit and seal against the vent plug 100. As an alternative, it is possible that another larger O-ring seal (not shown) could be either added or substituted for the smaller O-ring seal 112 by placing it within the cap 18 or at the base of the threads 17 on the housing 12. In this way, the cap will seal against the larger O-ring when the cap is installed. If the smaller O-ring seal 112 is rendered unnecessary, then it is also possible that vent plug 100 can be eliminated with the pull-wire 96 attached directly to the finger grip 28.

The friction primer or igniter 80 including the primer cup 90 and pull-wire 96 is of a type which is well known in the prior art and has been used for many years. The interior of the cup 90 can be filled with an ignition compound such as potassium chlorate and charcoal. The undulating portion 97 of the pull-wire 96, in turn, can be coated with a friction-sensitive compound such as red phosphorus.

OPERATION

The weather-proof safety fuse igniter 10 as shown and described in this application is extremely reliable and easy to use. When it is desired to ignite the safety fuse, it is merely necessary to turn the retainer 20 to the release or unlocked position. The shipping plug 21 is then easily removed from the end of the housing 12 and discarded. The safety fuse 22 is inserted into the opening 30 so that the end passes through the seal 25, second ferrule 84, and abuts against the crimped end 85 of first ferrule 82. By positioning the end of the fuse 22 adjacent to the crimped end 83 of the first ferrule 82, the fuse is properly positioned with respect to the friction primer 80 and is aligned to receive the directed flame generated in the igniter cup 90. In addition, the sharp points on the crimped end 85 of the second ferrule 84 retains the safety fuse 22 and prevents it from being accidentally withdrawn from the housing prior to or during ignition.

With the safety fuse 22 in position the retainer 20 is turned in the opposite direction to the locked position whereby the core 36 is pushed against the seal 25 to compress the seal against the internal support sleeve 23 and the outer sheath of the safety fuse 22. In this way, the end of the housing 12 is completely sealed to prevent the introduction of water or other contaminants. When it is desired to ignite the fuse, the cap 18 is removed and discarded. The pull-cord 28 is then grasped and pulled sharply outward and away from the end 16 of the housing 12. This removes the vent plug 100 from the bore 52 as well as drawing the pull-wire 96 through the primer cup 90. This motion causes the friction compound to ignite the primer material causing an intense flame to be generated which is directed through the ferrule 82 and against the exposed end of the safety fuse 22. The intense and concentrated flame front causes reliable ignition of the safety fuse 22 which through burning creates a considerable volume of exhaust gases. The vent apertures 57 in the support sleeve 23 meters the gases and allows these gases to quickly dissipate from the burning area. The gases pass outwardly through the exhaust chamber 60 surrounding the sleeve 23, through the slot 74, and out to the atmosphere through the bore 52. The size and placement of the exhaust apertures 57 as previously stated, are important to premote the reliable ignition and burning of the safety fuse. The inadequate venting of the exhaust gases can create a high internal pressure which can cause the fuse to be extinguished or cause the igniter to be damaged. On the other hand, it is possible that free and open venting of the burning gases can create a negative pressure around the end of the fuse which could actually cause the powder within the fuse to be extracted causing the fuse, in turn, to be extinguished.

Although a disposable weather-proof igniter for safety fuse has been shown and described in this application, it should be understood that this invention is not to be limited to the exact form disclosed, and changes in detail and construction of the invention may be made without departing from the spirit thereof.

What is claimed is:

1. A disposable weather-proof igniter for igniting safety fuse for detonating explosive devices and the like, the igniter comprising:

(a) a hollow elongated housing means;

(b) a sealing cap means for removably enclosing one end of said housing;

(c) a support sleeve means having a central bore for receiving said safety fuse, said sleeve means being arranged to be sealingly mounted within the end of said housing which is opposite said cap means, said sleeve means includes a sealing means positioned in conjunction with said central bore for closing the end of the housing means and preventing the passage of water or other contaminants;

(d) pull-wire type primer means mounted within said support sleeve, means said primer means having a primer ignition cup and a pull-wire extending through said cup, one end of said pull-wire extending toward the end of said housing means and having a means which can be gripped by the user when said sealing cap is removed, the opposite end of said pull-wire being coated with a friction ignition compound which will react with a primer ignition compound positioned within said cup when said pull-wire is quickly removed by the user; and (e) safety fuse retaining and positioning means provided within said support sleeve means for properly positioning the end of the fuse with respect to the primer means and retaining the fuse within the igniter when it is inserted prior to use.

2. A safety fuse igniter as defined in claim 1 wherein said support sleeve sealing means includes an elongated disposable plug having a diameter approximately the same as said safety fuse whereby the central bore of the support sleeve means can be sealed to prevent the incursion of water and other contaminants prior to the use of said safety fuse igniter.

3. A safety fuse igniter as defined in claim 1 wherein said support sleeve means is spaced from the interior surface of said housing means to form an exhaust chamber, said exhaust chamber is connected with the outer end of said housing bore so that the exhaust gases from the burning primer cup and safety fuse will exhaust to the atmosphere, and said support sleeve means includes one or more vent apertures which are sized to properly meter the exhaust gases to the exhaust chamber to precisely control the ignition and burning of the safety fuse.

4. A safety fuse igniter as defined in claim 1 wherein the outer surface of said housing means includes hand grip means which allows the user to firmly grip the igniter during activation of the primary ignition means.

5. A safety fuse igniter as defined in claim 1 wherein the grip means for the pull-wire for said ignition means includes a vent plug which is sized to generally fit within the outer end of the housing bore and a seal means is provided between the vent plug and housing to prevent the passage of water or other contaminants.

6. A safety fuse igniter as defined in claim 5 wherein said vent plug extends beyond the end of said housing and a pull-cord which can be gripped by the user is attached to the end of said vent plug for removal of said pull-wire, said pull-cord and said vent plug being arranged to be contained within said sealing cap means when the cap is installed on the end of said housing.

7. A safety fuse igniter as defined in claim 1 which further includes an enlarged cup retaining means mounted within said housing means and adjacent the inner end of said sleeve means, said cup retaining means includes a central bore which is sized to fit said primer cup and allow passage of the pull-wire.

8. A safety fuse igniter as defined in claim 7 wherein a ferrule is partially inserted into the inner end of the sleeve means, and said cup detaining means and said sleeve means are two separate components arranged with one end of the cup retailer means overlapping a portion of the ferrule whereby the ferrule acts as a support means between the sleeve means and the retainer portion.

9. A safety fuse igniter as defined in claim 8 wherein coupler means is provided for retaining the retainer means and sleeve means in adjacent position over said ferrule while the components are inserted into said housing bore.

10. A safety fuse igniter as defined in claim 1 wherein said retaining and positioning means includes first and second ferrules which are precisely positioned within the central bore of the support sleeve means, both of said ferrules having one end indented so as to reduce the diameter of the end, said ferrules being positioned within said central bore with the indented ends closest to each other.

11. A safety fuse igniter as defined in claim 10 wherein the second ferrule has one or more jagged pointed protrusions to grip the outer layer of the safety fuse when it is inserted to prevent the fuse from being withdrawn from the igniter.

12. A safety fuse igniter as defined in claim 10 wherein the first ferrule which is arranged closest to said primer ignition cup is positioned with said indented end located away from said ignition cup and is precisely positioned a predetermined distance from said cup so that when the safety fuse is inserted until the end of the fuse abuts the indented end of said first ferrule the primer flame issuing from said cup will be directed through said ferrule so as to ignite the end of said safety fuse.

13. A safety fuse igniter as defined in claim 12 wherein said first ferrule is metallic to prevent the flame from burning through the support sleeve means.

14. A disposable weather-proof igniter for igniting safety fuse for detonating explosive devices and the like, the igniter comprising:

(a) a hollow elongated housing means;

(b) a sealing means provided at one end of said housing means for removably sealing and preventing water or other contaminants from entering the one end of said housing means;

(c) a support sleeve means having a central bore therein for receiving and retaining a safety fuse inserted therein, said support sleeve means being fixedly mounted within the opposite end of said housing means from said sealing means, the central bore of said support sleeve means including a primer ignition means which can be ignited by removing the sealing means and activating said primary ignition means through the exposed end;

(d) a retainer means attached to the outer end of said support sleeve means and the end of said housing opposite the sealing means, said retainer means including a retainer and a seal means provided within said central bore of the sleeve means whereby the retainer can be properly portioned with respect to said seal means to seal against a safety fuse when inserted into said central bore and prevent the introduction of water or other contaminants into the said housing means.

15. A safety fuse igniter as defined in claim 14 wherein said sleeve means includes an outwardly extending flange arranged adjacent to the outer end of said housing means and said flange includes one or more outwardly extending ears, and said retainer includes one or more circular inclined planes around the perimeter of said retainer which are arranged to engage a corresponding flange ear where by as said retainer is rotated the retainer will move inwardly with respect to said support sleeve means so as to apply pressure to said seal means causing said seal means to seal against a safety fuse inserted within the central bore.

16. A safety fuse igniter as defined in claim 14 wherein the seal means provided within said central bore includes a shoulder provided within said bore and two circular ring-type seals positioned inside the bore adjacent said shoulder, said retainer having an elongated hollow center core which can be positioned within said central bore to apply pressure against said seal means when said retainer is moved from an unlocked position to a locked position.

17. A safety fuse igniter as defined in claim 16 wherein said ring-type seals are "O" rings.

18. A disposable weather-proof igniter for igniting safety fuse for detonating explosive devices and the like, the igniter comprising:

(a) a hollow elongated housing means;

(b) a removable sealing cap means for enclosing one end of said housing;

(c) a support sleeve means having a central bore for receiving said safety fuse said sleeve means being fixedly mounted in said housing means, said sleeve means including a pull-type primer ignition means mounted within said central bore, said ignition means being activated by a means arranged to extend beyond the outer end of said housing means which can be activated when said sealing cap means is removed;

(d) a first hollow ferrule having one end slightly indented inwardly with said end having a plurality of pointed teeth, said first ferrule being inserted into the central bore of said retaining sleeve means with the indented end away from said ignition means to a location where said indented end is positioned a predetermined distance away from the primer ignition means, a second ferrule means having a slightly indented end with said indented end having a plurality of pointed teeth, said second ferrule being arranged within said central bore of the retaining sleeve means opens from said first ferrule and in a direction whereby the safety fuse when inserted into said central bore passes through said ferrule with the teeth arranged so as to prevent the backward movement of said safety fuse;

(e) said support sleeve means has one or more metering apertures therein which are precisely sized and positioned with respect to the indented end of said first ferrule, said sleeve means includes a passageway between said sleeve means and said housing means for allowing the exhaust gases from the burning ignition means and fuse to pass through the apertures and passageway and through the outer end of said housing means after said sealing cap means has been removed; and (f) retainer means provided at the end of the housing means and adjacent to the end of said support sleeve means for sealing the end of said housing means prior to and after the insertion of the safety fuse.

19. A safety fuse igniter as defined in claim 18 wherein said retainer means includes a pair of O-rings positioned within the central bore of said support sleeve means and a compression cap means mounted on the end of said sleeve means whereby when the cap means is rotated from a first position wherein the safety fuse can be inserted into said central bore and then to a second locked position the cap will compress the O-rings within said central bore to provide a seal with said safety fuse to prevent the entrance of water or other contaminants into said igniter.

20. A safety fuse igniter as defined in claim 18 wherein said metering apertures are positioned in said sleeve means in the space between said first and second ferrule.

* * * * *